United States Patent [19]

Wang

[11] Patent Number: 5,000,441

[45] Date of Patent: Mar. 19, 1991

[54] SIMULATED CLIMBING EXERCISE DEVICE

[76] Inventor: Shui-Mu Wang, No. 25, Huan-Kung Rd., Yung-Kang Hsiang, Tainan Hsien, Taiwan

[21] Appl. No.: 586,411

[22] Filed: Sep. 21, 1990

Related U.S. Application Data

[63] Continuation-in-part of Ser. No. 514,130, Apr. 25, 1990, Pat. No. 4,982,952.

[51] Int. Cl.[5] ..... A63B 23/04

[52] U.S. Cl. ..... 272/70; 272/130

[58] Field of Search ..... 272/69, 70, 121, 126, 272/130, 96, 93; 128/25 R

[56] References Cited

U.S. PATENT DOCUMENTS 3,381,958 5/1968 Guillard ..... 272/121

4,838,543 6/1989 Armstrong et al. ..... 272/70

FOREIGN PATENT DOCUMENTS 8904697 6/1989 World Int. Prop. O. ..... 272/70

OTHER PUBLICATIONS

Versa Climber Brochure, 2 pages, 3001 Redhill Ave., Suite 106, Costa Mesa, Calif. 92626, Nov., 1987.

*Primary Examiner*—Stephen R. Crow

*Attorney, Agent, or Firm*—Marshall & Melhorn

[57] ABSTRACT

An exercise device includes a base, an elongated prop extending upward from the base and having an upper slide groove, a pair of slide pieces movably disposed on opposite sides of the elongated prop in the upper slide groove, a pair of handle pieces provided on the slide pieces, and a cable provided adjacent to the top end of the elongated prop to alternatingly move the slide pieces downward and upward along the upper slide groove. An inclined post connects the elongated prop to the base and supports the former in an upwardly inclining manner. A pair of elongated foot pedals are provided on opposite sides of the elongated prop on top of the base. Each of the foot pedals has a rear end hinged to the inclined post. A pair of vertical adjoining rods join each of the foot pedals to one of the slide pieces. A pair of hydraulic cylinders provide resistance to any movement of the foot pedals. Each of the hydraulic cylinders has a cylinder body hinged to one of the foot pedals and a piston rod pivoted on the inclined post adjacent to the elongated prop.

2 Claims, 6 Drawing Sheets

(4~4')

SIMULATED CLIMBING EXERCISE DEVICE

BACKGROUND OF THE INVENTION

This is a continuation in part of allowed U.S. patent application Ser. No. 07/514,130 filed on Apr. 25, 1990, now U.S. Pat. No. 4,982,952.

The invention relates to an exercise device, more particularly to a simulated climbing exercise device.

Referring to FIGS. 1 and 2, U.S. patent application Ser. No. 07/514,130 is shown to comprise a base 1, an elongated prop 2 extending upward from the base 1 and having an upper and a lower longitudinal slide groove 21 and 22; a pair of first slide pieces 23 movably disposed on opposite sides of the elongated prop 2 in the upper slide groove 21, each of the first slide pieces 23 having a handle piece 27; a pair of second slide pieces 24 movably disposed on opposite sides of the elongated prop 2 at the lower slide groove 22, each of the second slide pieces 24 having a foot support piece 28; a pair of vertical adjoining plates 25 connecting each of the first slide pieces 23 to one of the second slide pieces 24; a cable 26 to alternatingly move the vertical adjoining plates 25 downward and upward, the cable 26 being provided adjacent to the top end of the elongated prop 2; and a pair of hydraulic cylinder means 29 for providing resistance to any movement of the vertical adjoining plates 25, the hydraulic cylinder means 29 being hinged to the base 1 and connected to the second slide pieces 24.

When the exercise device is in use, the user's feet rest on the foot support pieces 28 and the user's hands grasp the handle pieces 27. The user pulls one of the handle pieces 27 or exerts a downward pushing force on one of the foot support pieces 28 to move one of the vertical adjoining plates 25 downwards and the other vertical adjoining plate 25 upwards. The hydraulic cylinder means 7 resists the movement of the vertical adjoining plates 25 to enable the exercise device to serve as training means for muscular development.

A main disadvantage of the above disclosed exercise device is that the foot support pieces 28 are provided on the second slide pieces 24. The user thus experiences some difficulty in properly positioning his feet on the foot support pieces 28. Furthermore, the user also experiences discomfort in using the foot pieces 28 since the foot pieces 28 support only a portion of the entire foot.

SUMMARY OF THE INVENTION

Therefore, the objective of the present invention is to provide an improved simulated climbing exercise device which eliminates the above mentioned disadvantages.

Another objective of the present invention is to provide an improved simulated climbing exercise device which can be dismantled into several sections to facilitate packaging, transporting and storing of the exercise device.

Accordingly, the preferred embodiment of an exercise device of the present invention comprises a base, an elongated prop extending upward from the base and having an upper slide groove, a pair of slide pieces movably disposed on opposite sides of the elongated prop in the upper slide groove, a pair of handle pieces transversely provided on the slide pieces, and a cable to alternatingly move the slide pieces downward and upward along the upper slide groove. The cable is provided adjacent to the top end of the elongated prop. An inclined post connects the elongated prop to the base and supports the latter such that the elongated prop stands in an inclining manner. A pair of elongated foot pedals are provided on opposite sides of the elongated prop on top of the base. Each of the foot pedals has a rear end hinged to the inclined post. A pair of vertical adjoining rods join each of the foot pedals to one of the slide pieces. A pair of hydraulic cylinder means provide resistance to any movement of the foot pedals. Each of the hydraulic cylinder means has a cylinder body hinged to one of the foot pedals and a piston rod pivoted on the inclined post adjacent to the elongated prop.

The elongated prop includes two separable and connectible sections and each of the vertical adjoining rods includes two separable and connectible rod pieces. This facilitates the packaging, transporting and storing of the exercise device according to the present invention.

BRIEF DESCRIPTION OF THE DRAWINGS

Other features and advantages of this invention will become apparent in the following detailed description of the preferred embodiment with reference to the accompanying drawings, of which.

DETAILED DESCRIPTION OF THE PREFERRED EMBODIMENT

Figure 1:
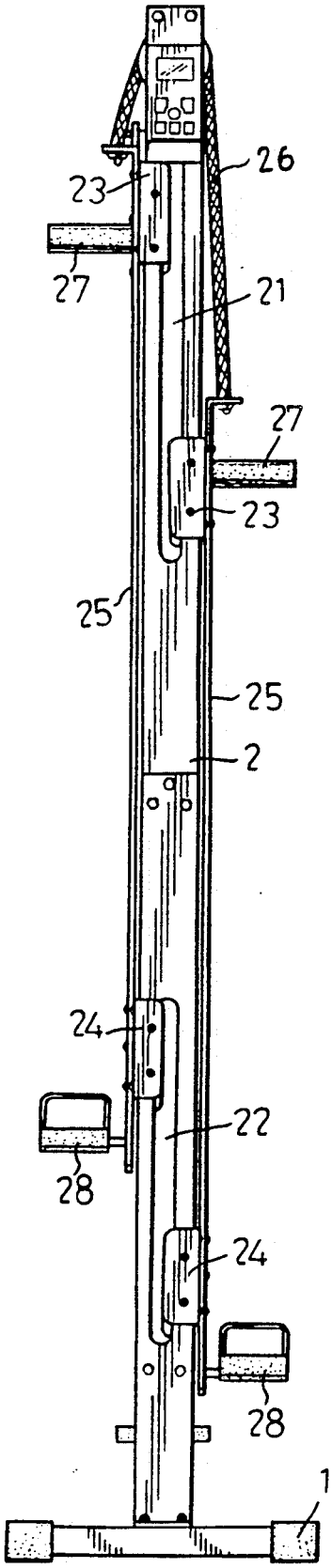
FIG. 1 (PRIOR ART)
FIG. 1 is a front view of the exercise device disclosed in U.S. patent application Ser. No. 07/514,130.
Figure 2:
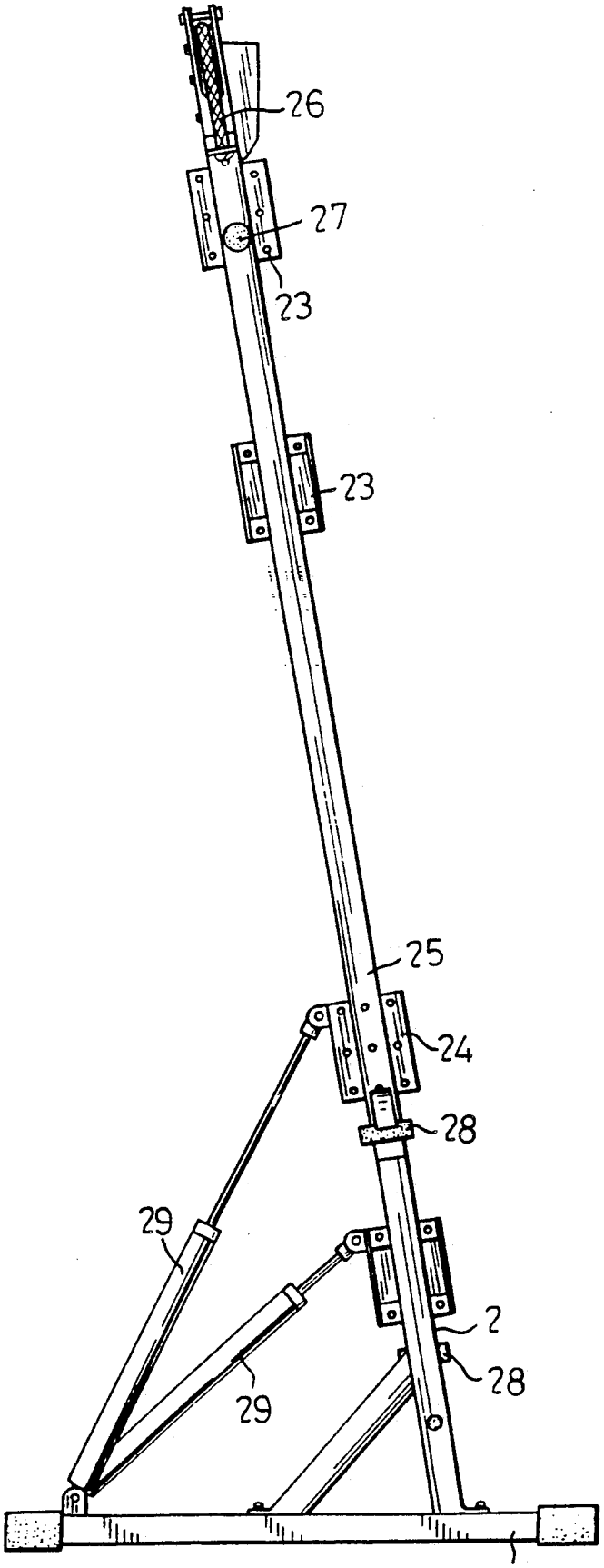
FIG. 2 (PRIOR ART)
FIG. 2 is a side view of the exercise device shown in FIG. 1.
Figure 3:
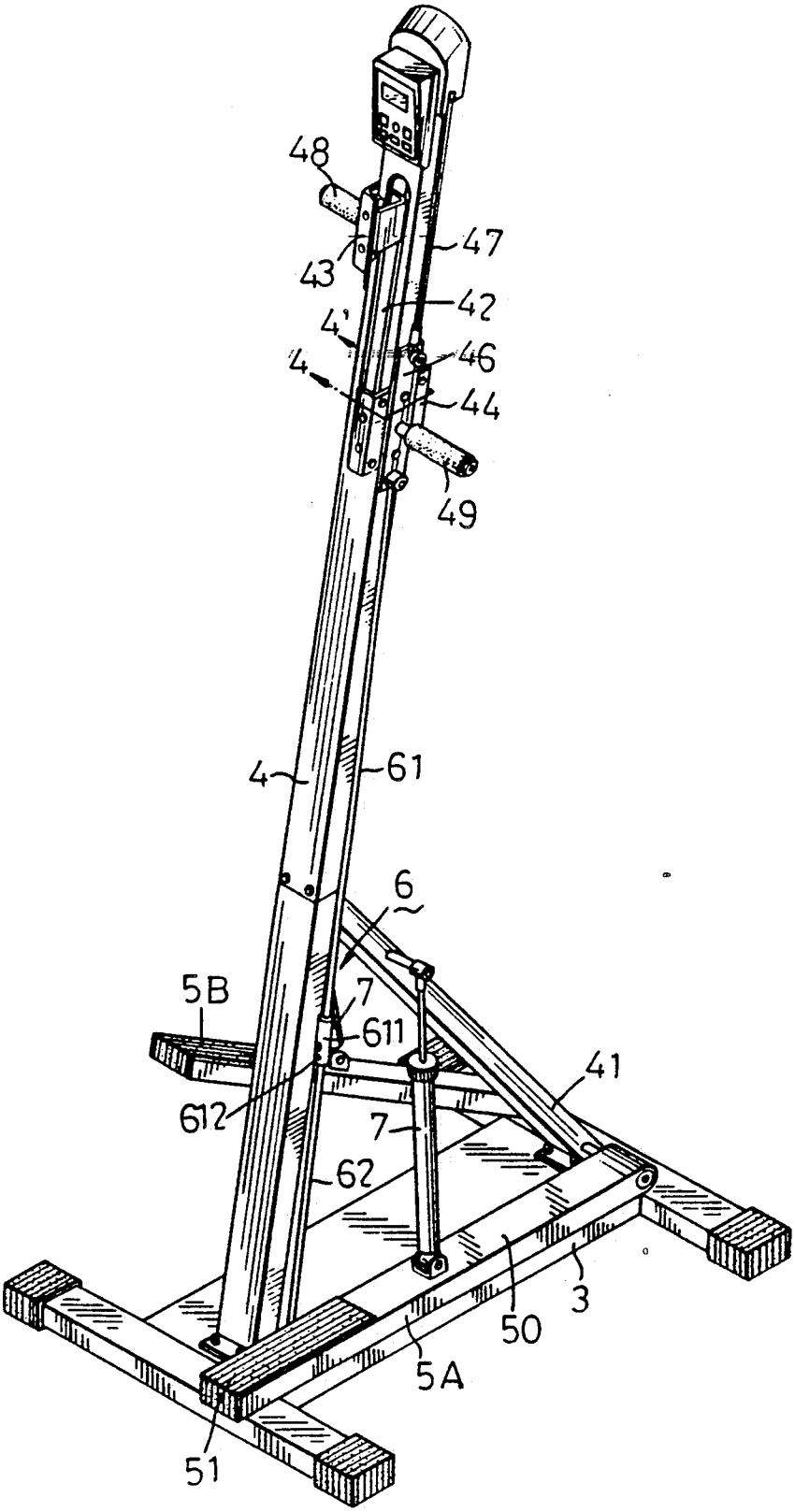
FIG. 3 is a perspective view of the preferred embodiment of the exercise device according to the present invention.
Figure 5:
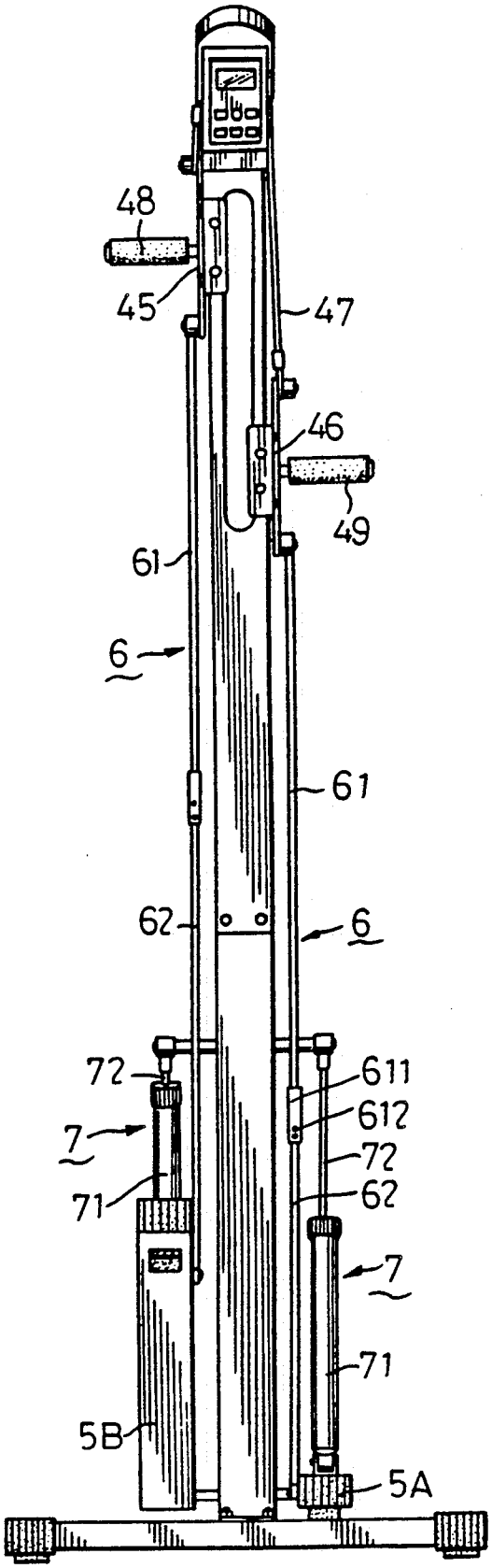
FIG. 5 is a front view of the preferred embodiment.

Referring to FIG. 3, the preferred embodiment of an exercise device according to this invention is shown to comprise an I-shaped base 3 which supports an elongated prop 4 having an upper longitudinal slide groove 42. A post 41 is connected to the base 3 and the elongated prop 4 and supports the latter in an upwardly inclining manner. Left and right slide pieces 43 and 44 are oppositely and movably disposed on the elongated prop 4 at the upper slide groove 42. Left and right connecting plates 45 and 46 are respectively attached to the outer sides of the left and right slide pieces 43 and 44. (The left connecting plate 45 is shown in FIG. 5). The top ends of the left and right connecting plates 45 and 46 are connected to two ends of a cable 47 provided adjacent to the top end of the elongated prop 4. A downward movement of one of the connecting plates 45 and 46 will thus cause the other connecting plate to move up. Left and right handles 48 and 49 are attached to the left and right connecting plates 45 and 46, respectively.

Figure 4:
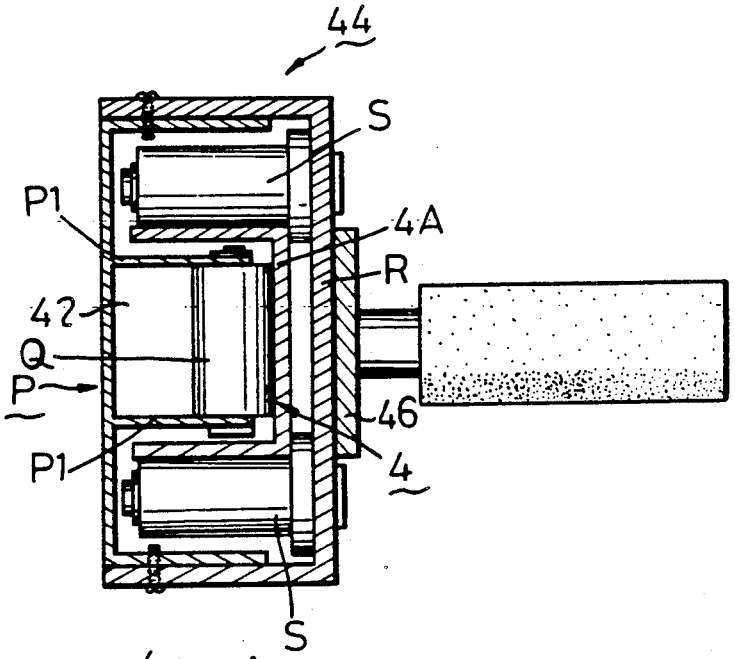
FIG. 4 is a sectional view of one of the slide pieces of the preferred embodiment to illustrate assembly.

As shown in FIG. 4, each of the left and right slide pieces 43 and 44 comprises a first casing part P, a first roller Q, a second casing part R and a pair of second rollers S.

The first and second casing parts, P and R, are substantially U-shaped in cross section and are attached to one another with screws. A pair of partition plates P1 is parallel to the shorter, transverse sides of the first and second casing parts P and R. The first and second casing parts, P and R, surround one of the channel-like parts 4A of the elongated prop 4 adjacent to the slide groove 42. The first casing part P extends into the slide groove 42. Each of the connecting plates 45 and 46 is attached to one side of the second casing part R.

The first roller Q is rotatably mounted to the partition plates P1. The second rollers S are rotatably mounted to the second casing part R on two sides of the first roller Q. The second rollers S have an axis of rotation transverse to that of the first roller Q. The first and second rollers Q and S are in rolling contact with the channel-like division, part 4A, of the elongated prop 4.

Referring to FIGS. 3 and 5, left and right foot pedals, 5A and 5B, are provided on opposite sides of the elongated prop 4 on top of the base 3. Each foot pedal 5A and 5B includes a lever plate 50 having a rear end pivoted to the lower end of the post 41 and a front end with a foot rest 51. A pair of vertical adjoining rods 6 movably connects the left and right foot pedals 5A and 5B to the left and right connecting plates 45 and 46. Each vertical adjoining rod 6 comprises a first rod piece 61 having one end connected to the lower end of one of the connecting plates 45 and 46, a second rod piece 62 having one end connected to the other end of the first rod piece 61 by means of a connecting piece 611. Screws 612 secure the first and second rod pieces 61 and 62 to the connecting piece 611. The other end of the second rod piece 62 is connected to the front end of the lever plate 50 of one of the foot pedals 5A and 5B. Dividing the vertical adjoining rods 6 into first and second rod pieces 61 and 62 facilitates the packaging and transport of the preferred embodiment. The elongated prop 4 includes two or more separable and connectible sections so that the preferred embodiment can be conveniently stored when not in use.

The preferred embodiment further comprises a pair of hydraulic cylinders 7. Each hydraulic cylinder 7 has a cylinder body 71 hinged to the central portion of the lever plate 50 of one of the foot pedals 5A and 5B. Each hydraulic cylinder 7 further has a piston rod 72 hinged to the post 41 adjacent to the elongated prop 4.

Figure 6:
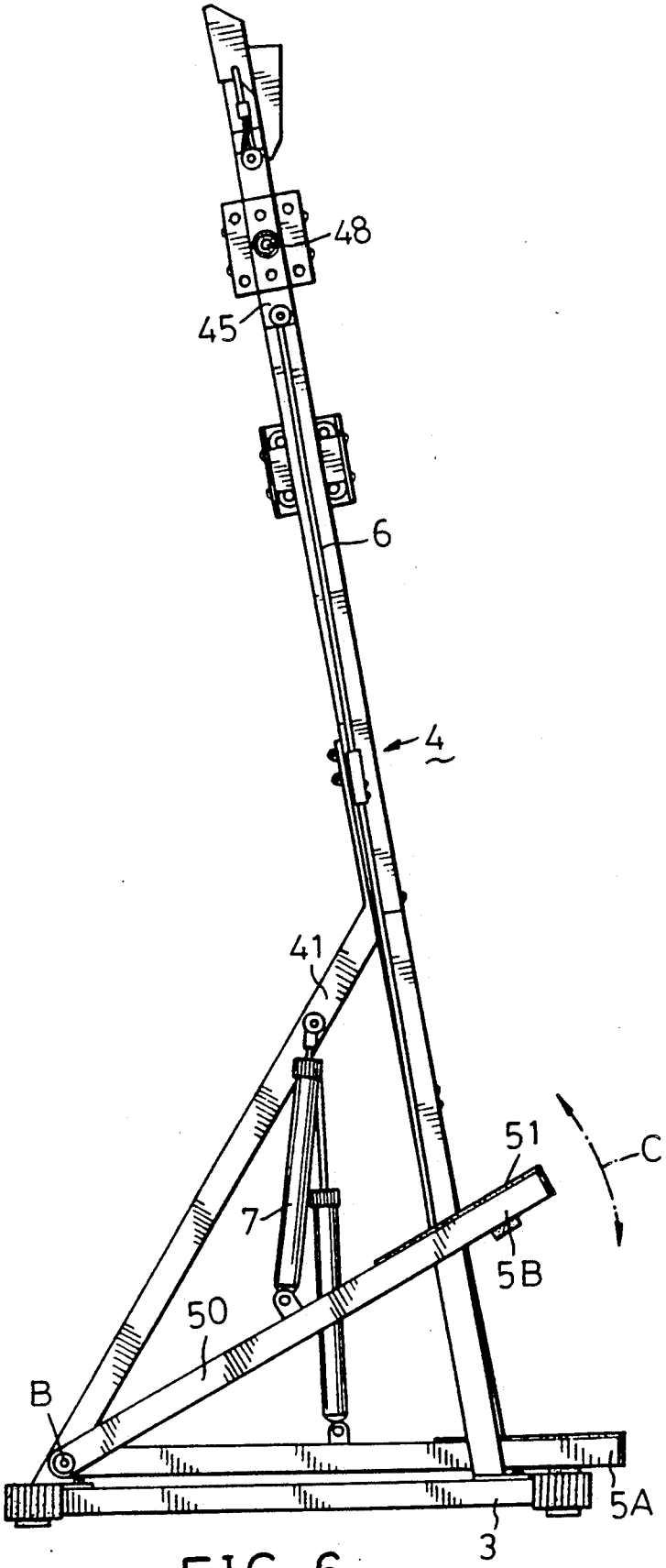
FIG. 6 is a side view of the preferred embodiment illustrating the movement of one of its foot pedals.

Referring to FIGS. 3 and 6, when the preferred embodiment is in use, the user's feet are placed on the foot rests 51 of the left and right foot pedals, 5A and 5B, while the user's hands grasp the left and right handles, 48 and 49. When exercising the arms, the user pulls one of the handles, 48 or 49, to move one of the vertical adjoining rods 6 downward and the other vertical adjoining rod 6 upward. The movement of the vertical adjoining rods 6 correspondingly move the left and right foot pedals 5A and 5B in opposite directions, thereby pushing or pulling the piston rods 72 against the cylinder bodies 71. The hydraulic cylinders 7 thus provide resistance to the movement of the left and right foot pedals 5A and 5B to enable the preferred embodiment to serve as a training means for muscular development.

Accordingly, when exercising the legs, the user exerts a downward pushing force on the left or right foot pedals, 5A or 5B, to overcome the resistance provided by the hydraulic cylinders 7. The means for overcoming the resistance provided by the hydraulic cylinders 7 is not restricted to the pulling of one of the handles, 48 or 49, or to the pushing of one of the foot pedals, 5A or 5B. The user may employ a combination of the two means, depending upon the desired development of physique, to overcome the resistance of the hydraulic cylinders 7.

Referring once more to FIG. 6, the lever plate 50 of each of the foot pedals 5A and 5B is shown to be hinged to the lower end of the post 41 at hinge point B. The front ends of the lever plates 50 thus move in an arcual path C when the vertical adjoining rods 6 move in an upward or downward direction. The vertical adjoining rods 6 are hinged to the connecting plates 45 and 46 and to the foot pedals 5A and 5B to permit movement of the front ends of the lever plates 50 in the arcual path C.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An exercise device comprising a base, an elongated prop extending upward from said base and having an upper slide groove, a pair of slide pieces movably disposed on opposite sides of said elongated prop in said upper slide groove, a pair of handle pieces provided on said slide pieces, a cable to alternatingly move said slide pieces downward and upward along said upper slide groove, said cable being provided adjacent to a top end of said elongated prop, a pair of foot pedals cooperatively and movably associated with said handle pieces, a pair of hydraulic cylinder means associated with said foot pedals to provide a resisting force against any movement of said foot pedals, and improvements wherein:

said exercise device further comprises an inclined post connecting said base to said elongated prop, said inclined post supporting said elongated prop such that said elongated prop stands in an inclining manner; and a pair of vertical adjoining rods to join each of said foot pedals to one of said slide pieces;

each of said foot pedals including an elongated lever plate having a rear end hinged to said inclined post and a front end with a foot rest, each of said foot pedals being provided on opposite sides of said elongated prop on top of said base;

each of said hydraulic cylinder means having a cylinder body hinged to said lever plate of one of said foot pedals and a piston rod pivoted on said inclined post adjacent to said elongated prop.

2. The exercise device as claimed in claim 1, wherein said elongated prop includes at least two separable and connectible sections and each of said vertical adjoining rods includes at least two separable and connectible rod pieces to facilitate packaging, transporting and storing of said exercise device.

* * * * *